US010246987B2

(12) United States Patent
Gosney

(10) Patent No.: US 10,246,987 B2
(45) Date of Patent: Apr. 2, 2019

(54) METHODS AND SYSTEMS FOR ORIENTING A TOOL IN A WELLBORE

(71) Applicant: Halliburton Energy Services, Inc., Houston, TX (US)

(72) Inventor: Jon T. Gosney, Bellville, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 490 days.

(21) Appl. No.: 15/024,956

(22) PCT Filed: Oct. 22, 2013

(86) PCT No.: PCT/US2013/066044
§ 371 (c)(1),
(2) Date: Mar. 25, 2016

(87) PCT Pub. No.: WO2015/060817
PCT Pub. Date: Apr. 30, 2015

(65) Prior Publication Data

US 2016/0237805 A1 Aug. 18, 2016

(51) Int. Cl.
*E21B 23/12* (2006.01)
*E21B 47/024* (2006.01)
(Continued)

(52) U.S. Cl.
CPC ..... *E21B 47/024* (2013.01); *E21B 17/05* (2013.01); *E21B 17/07* (2013.01); *E21B 17/08* (2013.01);
(Continued)

(58) Field of Classification Search
CPC ..... E21B 47/024; E21B 23/002; E21B 29/06; E21B 7/061; E21B 23/01; E21B 23/02; E21B 41/0035; E21B 47/09
See application file for complete search history.

(56) References Cited

U.S. PATENT DOCUMENTS 5,871,046 A 2/1999 Robison
6,012,527 A 1/2000 Nitis et al.
(Continued)

FOREIGN PATENT DOCUMENTS

CN 102146777 A 8/2011
GB 2346911 A 8/2000
(Continued)

OTHER PUBLICATIONS

International Search Report and the Written Opinion of the International Search Authority, or the Declaration, dated Jul. 10, 2014, PCT/US2013/066044, 17 pages, ISA/KR.
(Continued)

*Primary Examiner* — Daniel P Stephenson

(57) ABSTRACT

Methods and assemblies that can be used to orient a second pipe with respect to a first pipe in a wellbore are disclosed. The first pipe may be a casing string that includes one or more recessed latch couplings, and the second pipe may be a tubing string that includes one more complementary radially extendable latch keys that may be received within the latch couplings. The tubing string may include one or more switches associated with the latch keys that are actuated when the latch keys are received within the latch couplings. The actuation of the switches is communicated to an operator at the surface via control lines within the tubing string.

20 Claims, 11 Drawing Sheets

(51) Int. Cl.

| | |
|---|---|
| ***E21B 29/06*** | (2006.01) |
| ***E21B 19/16*** | (2006.01) |
| ***E21B 23/02*** | (2006.01) |
| ***E21B 41/00*** | (2006.01) |
| ***E21B 17/07*** | (2006.01) |
| ***E21B 17/08*** | (2006.01) |
| ***E21B 17/05*** | (2006.01) |
| ***E21B 47/12*** | (2012.01) |

(52) U.S. Cl.
CPC ..... *E21B 19/16* (2013.01); *E21B 23/002* (2013.01); *E21B 23/02* (2013.01); *E21B 29/06* (2013.01); *E21B 41/0035* (2013.01); *E21B 47/12* (2013.01)

(56) References Cited

U.S. PATENT DOCUMENTS

| | | | | |
|---|---|---|---|---|
| 6,244,340 | B1 | 6/2001 | McGlothen et al. | |
| 6,315,054 | B1 | 11/2001 | Brunet | |
| 6,386,287 | B2 * | 5/2002 | George | E21B 7/061 166/117.6 |
| 6,725,924 | B2 * | 4/2004 | Davidson | E21B 33/0355 166/250.01 |
| 8,376,054 | B2 | 2/2013 | Lang et al. | |
| 8,826,988 | B2 * | 9/2014 | Gray | E21B 23/04 166/341 |
| 2001/0035288 | A1 | 11/2001 | Brockman et al. | |
| 2002/0162656 | A1 | 11/2002 | Dewey | |
| 2004/0020648 | A1 | 2/2004 | Dewey et al. | |
| 2004/0163809 | A1 * | 8/2004 | Mayeu | E21B 34/06 166/255.1 |
| 2011/0186291 | A1 | 8/2011 | Lang et al. | |
| 2016/0237805 | A1 * | 8/2016 | Gosney | E21B 17/05 |
| 2016/0265314 | A1 * | 9/2016 | Saurer | E21B 23/002 |

FOREIGN PATENT DOCUMENTS

| | | | |
|---|---|---|---|
| RU | 2263783 | | 11/2005 |
| WO | WO-0165053 | A1 | 9/2001 |
| WO | WO 2001/098632 | A1 | 12/2001 |
| WO | WO-2004070164 | A1 | 8/2004 |

OTHER PUBLICATIONS

Intellectual Property Office of Singapore, Application No. 11201602349Y, Written Opinion, dated Apr. 6, 2018, 4 pages, Singapore.
Intellectual Property Office of Singapore, Written Opinion and Search Report, dated Apr. 10, 2017, 9 pages, Singapore.
Federal Service on Intellectual Property (Rospatent), Decision on Grant and Search Report, English Translation, dated May 2, 2017, 11 pages, Russia.
Federal Service on Intellectual Property (Rospatent), Decision on Grant and Search Report, dated May 2, 2017, 17 pages, Russia.
Office Action issued for Chinese Patent Application No. 201380079993.X dated May 31, 2017, 24 pages (with translation).
European Patent Office, Application No. 13895909.3, Supplementary European Search Report, dated Aug. 25, 2017, 11 pages, Europe.

* cited by examiner

METHODS AND SYSTEMS FOR ORIENTING A TOOL IN A WELLBORE

The present application is a U.S. National Stage patent application of International Patent Application No. PCT/US2013/066044, filed on Oct. 22, 2013, the benefit of which is claimed and the disclosure of which is incorporated herein by reference in its entirety.

TECHNICAL FIELD

The present disclosure relates generally to oilfield equipment, and in particular to downhole tools. More specifically, the disclosure relates generally to methods and systems for orienting strings, or portions of strings in a wellbore and, more particularly (although not necessarily exclusively), to orienting a tubing string window with respect to a casing string window in a wellbore.

BACKGROUND

Hydrocarbons can be produced through a wellbore traversing a subterranean formation. The wellbore can include one or more lateral wellbores extending from a parent (or main) wellbore. A lateral wellbore can be formed, for example, by diverting a milling tool in the parent wellbore through an opening that is a window of a casing string. The casing string can include multiple windows, one window for each lateral wellbore.

A tubing string can be located in the wellbore. The tubing string can include various tools or components that can be used to produce hydrocarbons from the formation, for example. The tubing string can include windows, or tubing string portions or targets through which windows can be formed, for alignment with the casing string windows. Aligning a tubing string window, or a particular tubing string wall portion, with a casing string window, or a particular casing string wall portion, in the wellbore can be difficult.

Various tools have been used to position a tubing string at a selected depth in a wellbore and for angular orientation of the string in a wellbore. The tools often require the tubing string rotated substantially, such as more than 180 degrees, to position the tubing string properly. Such a substantial rotation can be undesirable in some applications. For example, a tubing string can include one or more control lines that provide a medium for communication, power, and other services in the wellbore. Substantially rotating a portion of the tubing string that includes one or more control lines can cause stress on the control lines, which may result in damage to the control lines.

Therefore, systems and methods are desirable that can orient a tubing string with respect to a casing string in a wellbore. Systems and methods are also desirable that can perform such orientation without requiring substantial rotation in the wellbore of the tubing string with respect to the casing string.

BRIEF DESCRIPTION OF THE DRAWINGS

Embodiments are described in detail hereinafter with reference to the accompanying figures, in which.

DETAILED DESCRIPTION

Figure 1:
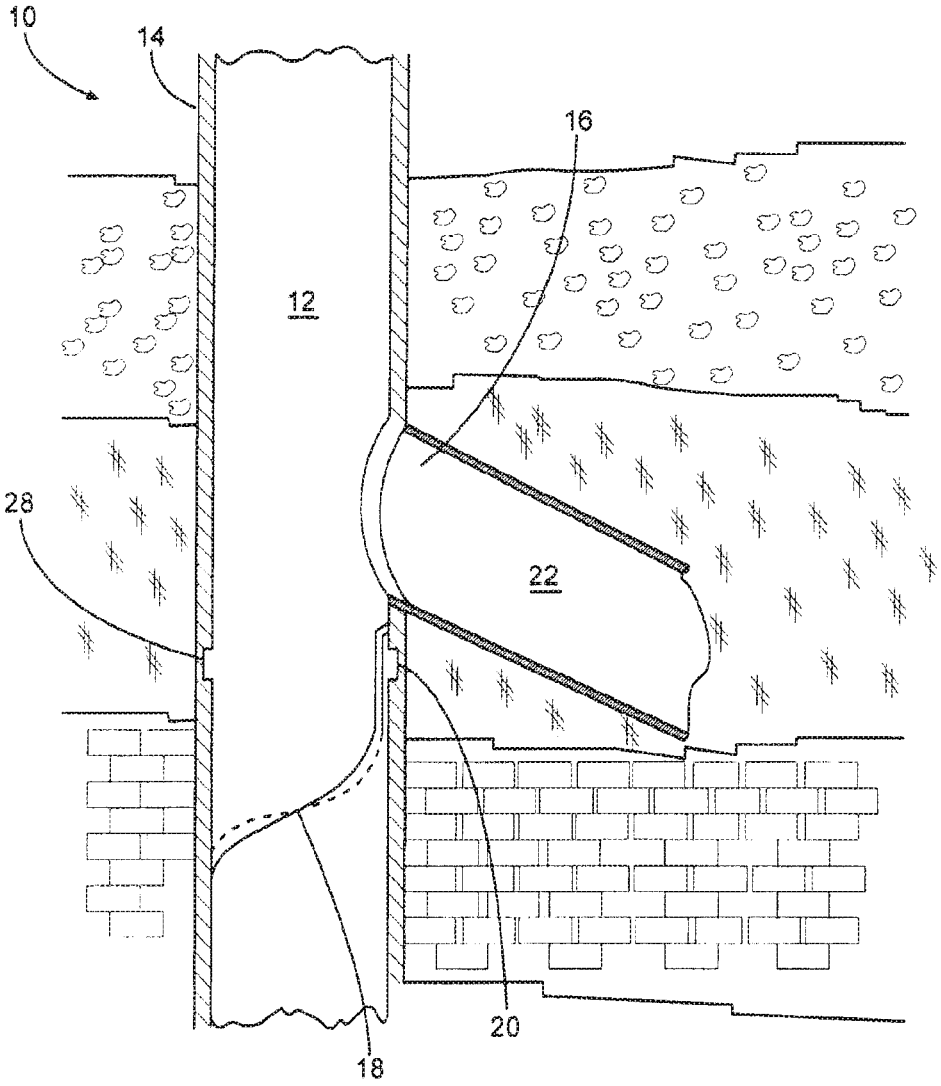
FIG. 1 is an axial cross-section of a well system having a parent wellbore and a lateral wellbore, along with a casing string and a tool disposed in the parent wellbore, according to an embodiment.

Certain aspects and embodiments relate to assemblies capable of being disposed in a wellbore of a subterranean formation and with which a second pipe can be oriented with respect to a first pipe in the wellbore. As used herein, "pipe" can refer to any tubular, casing or the like disposed in a wellbore. An assembly according to certain embodiments can allow the second pipe to be oriented with respect to the first pipe so that one or more target portions of the second pipe are positioned relative to one or more target portions in the first pipe. The target portions may be windows in one or both of the respective pipes. A window can include an opening in a wall of a pipe or an area disposed for milling or cutting an opening therethrough. Such windows may provide an opening through which a portion of the formation adjacent to the opening can be accessed to form a lateral wellbore, for example. A lateral wellbore is a wellbore drilled outwardly from its intersection with a parent wellbore. In other embodiments, target portions may be simply be relative portions of the respective pipes for which alignment is desired.

Certain assemblies can orient the second pipe and avoid damaging one or more control lines that may be associated or included with the second pipe. Furthermore, certain assemblies can be used to orient multiple portions of the second pipe with respect to multiple windows of the first pipe.

In some embodiments, the assembly includes a tool coupled to the first pipe that can direct the second pipe to a select axial position in the wellbore. The assembly can also include a device that can prevent rotation by the second pipe with respect to the first pipe after the second pipe is directed by the tool. An example of a first pipe is a casing string capable of being located in a wellbore. An example of a second pipe is a tubing string capable of being located in the wellbore.

Tools according to various embodiments can be any structures in any configurations that can guide a second pipe from a first position to a second position that is closer to an interior wall of a first pipe in the wellbore. An example of such a tool is a mule shoe located within a casing string in a wellbore. Generally, a mule shoe is capable of receiving a tubing string at a first end of the mule shoe and guiding the tubing string along a ramp to a second end of the mule shoe that is closer to the casing string wall than the first end. The tubing string at the second end can result in a desired portion of the tubing string being adjacent to a casing string window. In some embodiments, the tubing string includes a tubing string window that is at least partially adjacent to a casing string window when the tubing string is at the second end.

Devices for preventing rotation according to various embodiments can include any structures or configurations that can prevent a second pipe from rotating with respect to a first pipe. Devices according to some embodiments include a latch coupling, such as a latch coupling that includes a collet configured to receive and retain a latch key extending from the second pipe.

In some embodiments, the second pipe is a tubing string provided with multiple windows to be aligned with casing string windows of a casing string that is the first pipe. The tubing string can include a joint that is capable of allowing rotation by portions of the tubing string independently of other portions of the tubing string. In some embodiments, the joint can be used to align multiple tubing string windows with multiple casing string windows.

FIG. 1 shows a well system 10 that includes a parent wellbore 12 according to one embodiment that extends through various earth strata. The parent wellbore 12 includes a casing string 14 cemented at a portion of the parent wellbore 12. The casing string 14 includes a window 16 that is an opening in a sidewall portion of the casing string 14. The casing string 14 also includes a tool 18 capable of directing a tubing string (not shown) to a position and includes a device 20 capable of preventing the tubing string from rotating with respect to the casing string 14 after the tubing string is at the position. The casing string 14 may be made from a suitable material such as steel.

FIG. 1 shows a lateral wellbore 22 extending from the parent wellbore 12. The lateral wellbore 22 can be formed by running a whipstock or other diverting device to a location proximate to the window 16. Cutting tools, such as mills and drills, can be lowered through the casing string 14 and deflected toward the window 16, or toward a portion of the casing string 14 at which a window is to be formed. The cutting tools mill through the window 16 and the subterranean formation adjacent to the window 16 to form the lateral wellbore 22.

Figure 2:
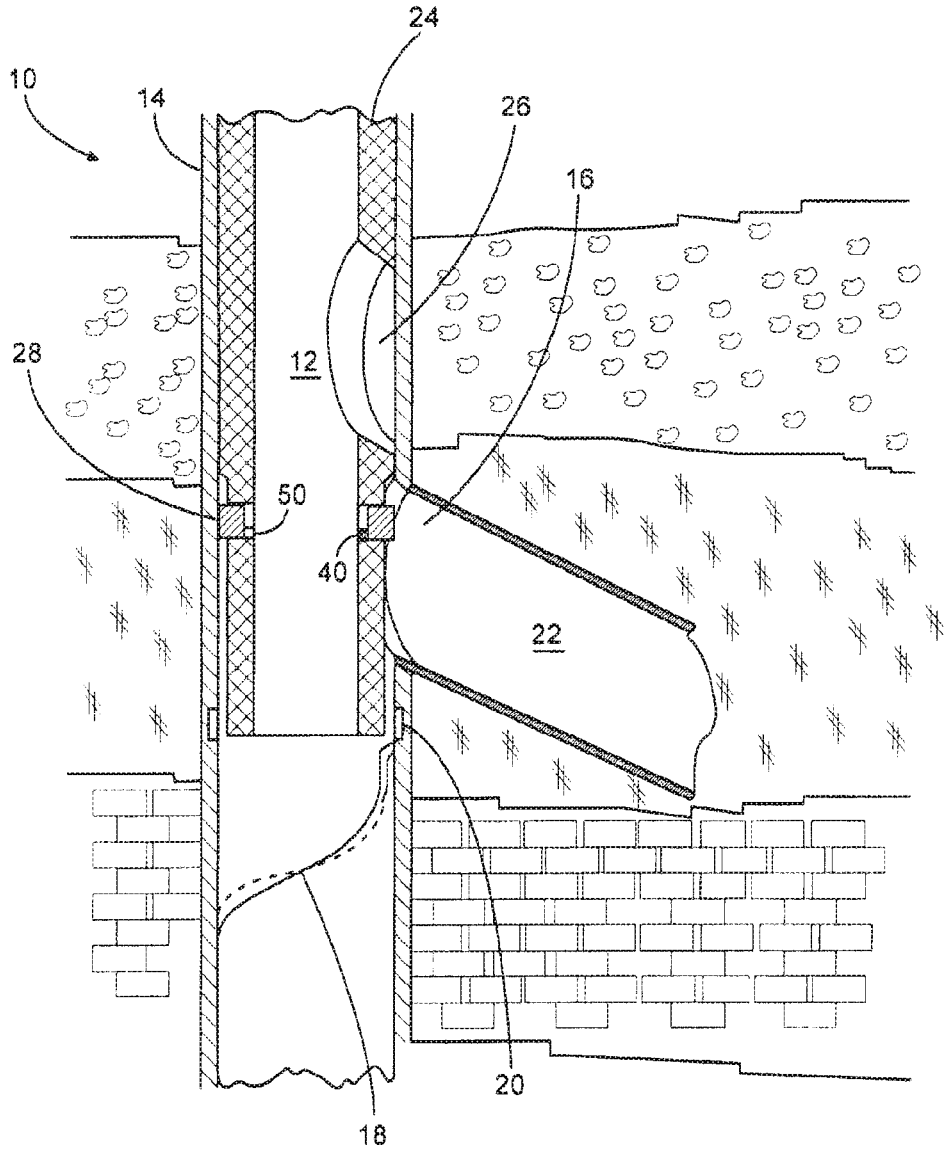
FIG. 2 is an axial cross-section of the well system of FIG. 1 with a tubing string disposed in the casing string.
Figure 3:
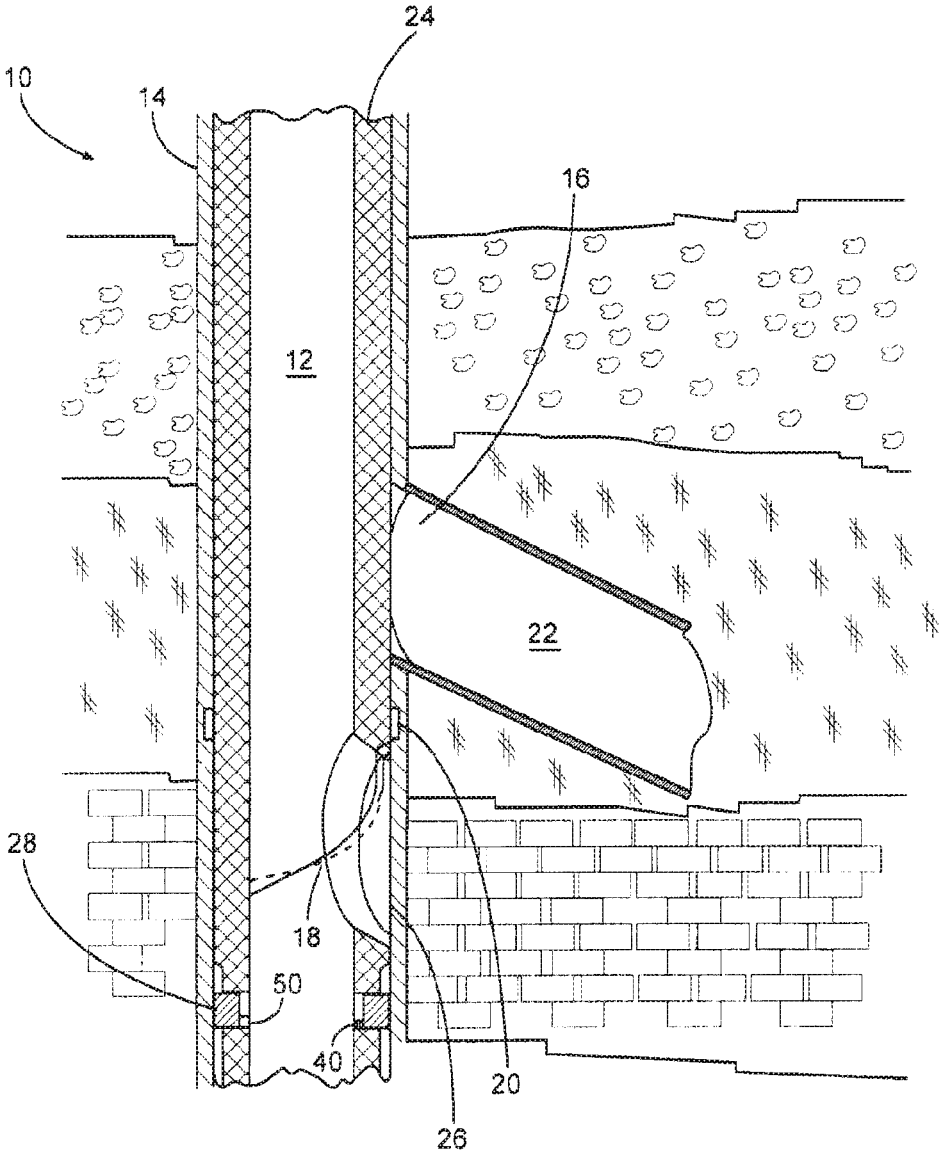
FIG. 3 is an axial cross-section of the well system of FIG. 2 with the tubing string positioned at an initial position.
Figure 4:
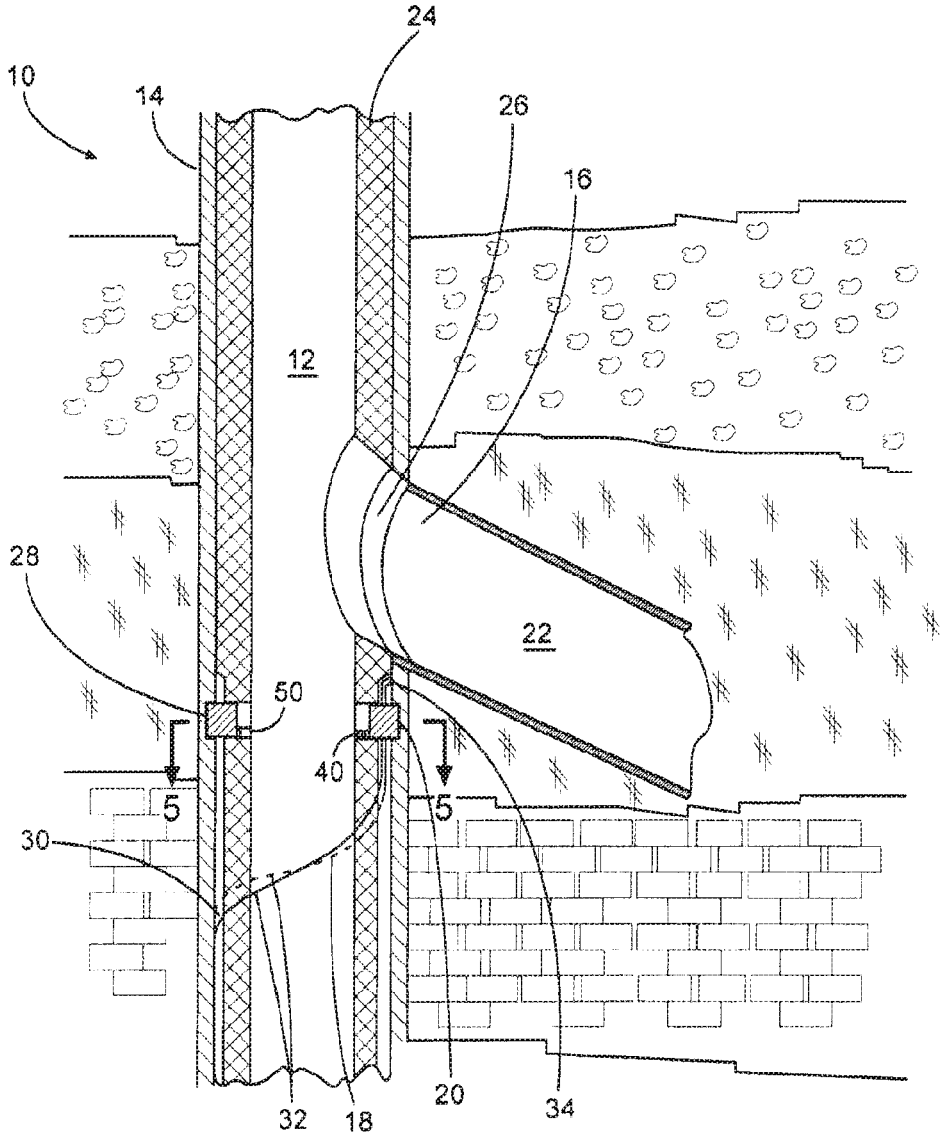
FIG. 4 is an axial cross-section of the well system of FIG. 3 with a tubing string oriented to a second position that is closer to the surface than the initial position.

A tubing string can be run within the casing string 14 to assist in hydrocarbon production or otherwise. Certain embodiments can be used to orient the tubing string with respect to the casing string 14 to allow, for example, the lateral wellbore 22 to be accessed via the tubing string. FIGS. 2-4 depict a tubing string 24 being oriented with respect to the casing string 14 via an assembly according to one embodiment. Although FIGS. 2-5 depict a tubing string being oriented with respect to a casing string, embodiments can be used to orient any type of pipe (or tool or device) with respect to another.

FIG. 2 depicts the tubing string 24 being run in an inner region of the casing string 14. The tubing string 24 can be run via any technique or method. The tubing string 24 includes a tubing string window 26 that is an opening in a sidewall of the tubing string 24. The tubing string 24 also includes a latch key 28 extending from an outer portion of the tubing string 24. In some embodiments, the latch key 28 is a spring-loaded member that is capable of extending from an outer boundary of the tubing string 24. Certain embodiments can be used to position the tubing string window 26 with respect to the casing string 14 in the parent wellbore 12.

The tubing string 24 can be run to an initial position, as shown in FIG. 3. At the initial position, the tubing string window 26 is located below the window 16 of the casing string 14 such that the window 16 is uphole of the tubing string window 26. Furthermore, the tool 18 is uphole of at least part of the tubing string 24 when the tubing string 24 is at the initial position.

From the initial position, the tubing string 24 can be moved toward the surface or uphole to be oriented such that at least part of the tubing string window 26 is adjacent to at least part of the window 16, as depicted in FIG. 4. Moving the tubing string 24 toward the surface can cause the tool 18 to direct the tubing string 24 to a second position at which at least a part of the tubing string window 26 is adjacent to the window 16. At the second position, the device 20 can prevent the tubing string 24 from rotating with respect to the casing string 14. For example, the device 20 may be a latch coupling that can receive the latch key 28 extending from the tubing string 24. In some embodiments, the latch coupling also prevents the tubing string 24 from changing depth in one or more directions, such as downward. An example of a latch coupling is a J-slot. Assemblies according to some embodiments can include a depth reference coupling that can be used to find depth downhole.

Latch couplings according to various embodiments can be any device or configuration that can prevent rotation of the tubing string 24 with respect to the casing string 14 when the tubing string is at the second position. In some embodiments, the latch coupling is a keyless latch.

For example, the latch coupling can include receiving recesses formed on the inner surface of a casing string. The receiving recesses can be spaced circumferentially around the inner surface of the casing string and include varying profiles. The receiving recesses can be configured to mate with spring-loaded latches having profiles corresponding to those of the receiving recesses. The spring loading forces each latch to move out radially and to mate in a recess when the latches are properly aligned axially and circumferentially with the recess. These latch couplings can be used to, for example, avoid clearance restricting projections extending inwardly from a string wall and allow weight to be set on a landed system. These latch couplings used in conjunction with the mule shoe can also allow a tubing string to be run past a desired depth, moved to the desired depth and orientation in accordance with the profile, thereby preventing the tubing string from being moved past the desired depth.

In some embodiments, assemblies include this type of latch coupling as a second latch coupling in addition to the latch coupling for positioning a tubing string with respect to a casing string. For example, this type of latch coupling can be used to position whipstocks or other components.

Tools according to various embodiments can be in any configuration that can direct a pipe to a second axial position from a first axial position without requiring the pipe to rotate substantially. Desirably, such rotation is less than 180 degrees. In other embodiments, tools can be provided that allow for 360 degree rotation in orienting one pipe with respect to another. In the embodiments shown in FIG. 4, the tool 18 is a mule shoe assembly that has a pointed first end 30 to complement part of the tubing string 24. For example, the tubing string 24 can include one or more keys that may be spring loaded that cooperate with the first end 30 when the tubing string 24 is moved toward the surface.

The first end 30 can direct the tubing string 24 to guides 32 as the tubing string 24 is moved upward toward the surface. The guides 32 may be a pair of curved, generally helical edges extending from the first end 30 to a second end 34 that is closer to the surface than the first end 30. The guides 32 can direct the tubing string 24 to a proper axial and rotational position relative to a longitudinal axis defined by the parent wellbore 12. In some embodiments, the second end 34 intersects a latch coupling for receiving the latch key 28. When the latch coupling receives the latch key 28, it can prevent rotation by the tubing string 24 with respect to the casing string 14. At least part of the tubing string window 26 can be aligned with at least part of the window 16 when the tubing string 24 is directed to the proper position.

Using a mule shoe can limit the amount of rotation needed by the tubing string 24, such as to no more than 180 degrees. For example, the tubing string 24 can be directed by one of the two guides 32 such that rotation of the tubing string 24 to reach the second position is prevented from exceeding 180 degrees.

Figure 5:
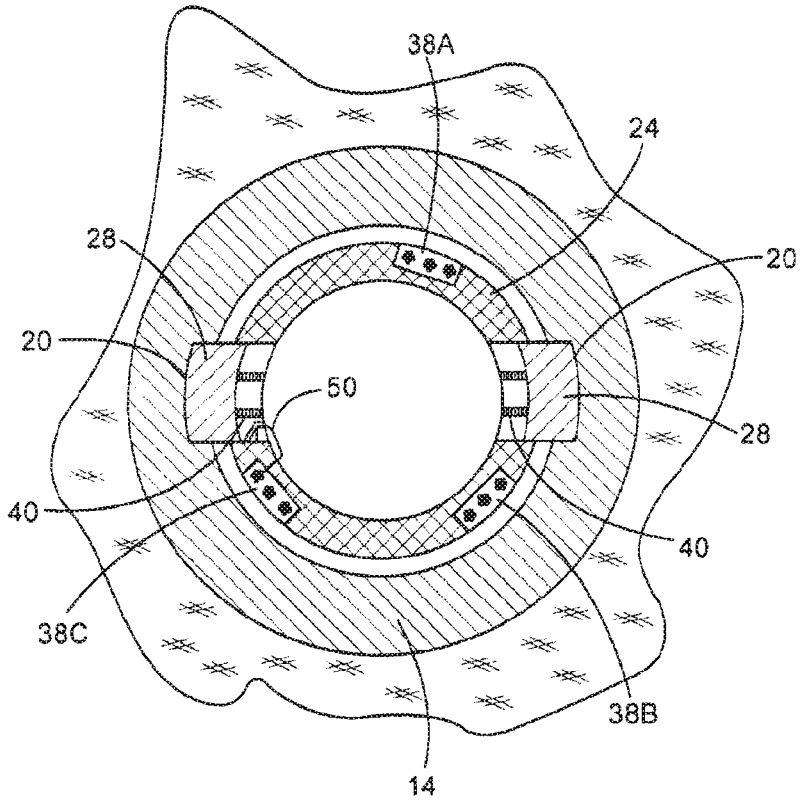
FIG. 5 is an axial cross-section of the assembly of FIG. 4 taken along line 5-5 of FIG. 4, showing the latch keys engaged within the latch couplings.

The latch key 28 may be a spring-loaded latch key configured to be received by the latch coupling when the tubing string 24 is at the desired position. FIG. 5 depicts a cross-sectional view of an embodiment of the latch coupling receiving the latch key 28, taken along line 5-5 of FIG. 4. The casing string 14 includes a device that is a latch coupling 20 that is shaped to receive the latch key 28 extending from an outer boundary of the tubing string 24. The tubing string 24 can be located in an inner region of the casing string 14.

The tubing string 24 can include one or more control lines, such as control lines 38A-C. The control lines 38A-C may include a medium through which power can be provided to one or more tools or other devices positioned in the wellbore or through which data and control signals can be communicated between such tools or devices and instruments located at or near the surface. The tubing string 24 can also include springs 40 disposed between the latch and an inner wall of the tubing string 24. The springs 40 cause the latch key 28 to extend outwardly from an outer boundary of the tubing string 24. Although springs 40 are depicted in FIG. 5, any suitable device can be used to urge latch key 28 radially outward. An example of such a device is a collet. The latch key 28 can be received by the latch coupling 20 and can cooperate with the latch coupling 20 to prevent the tubing string 24 from rotating with respect to the casing string 14. Although FIG. 5 depicts two latch keys 28, any number, from one to many, of latch keys can be used with various embodiments. In some embodiments, three or four latch keys 28 are used.

Certain embodiments minimize the likelihood of breaking one or more of the control lines 38A-C while positioning the tubing string 24 in the parent wellbore 12 by preventing the tubing string 24 from substantial rotation. For example, the tubing string 24 can be prevented from rotating more than 180 degrees in moving the tubing string 24 to the desired position and can be prevented from rotating after it is in the desired position.

Certain embodiments can be implemented in multilateral wellbores to allow positioning of a tubing string with respect to a casing string to align multiple tubing string windows with multiple casing string windows. A multilateral wellbore can include a parent (or main) wellbore with more than one lateral wellbore extending from it. A casing string can be positioned in the parent wellbore. The casing string can include windows (or windows can be formed in the casing) through which the lateral wellbores can be formed and accessed.

A tubing string can be positioned in an inner region of the casing string. The tubing string can include tubing string windows (or portions of a side wall through which windows are to be formed). Each tubing string window is to be aligned generally with a window of the casing string. Certain embodiments can be used to align the tubing string windows generally with the windows in the casing string and to avoid requiring the tubing string to be rotated substantially.

Latch couplings provide surface operators with confirmation that the tubing string is aligned at the proper depth and/or azimuthal orientation, because they prevent downward movement by the tubing string if properly aligned, but allow downward movement if not properly aligned. In preferred embodiments, one or more latch coupling engagement switches 50 may be employed to provide notification to the surface operator of a condition or configuration of a latch key, i.e., whether the latch key is radially retracted or extended. Such a condition or configuration may indicate that the latch key 28 has engaged the latch coupling 20 via a control line 38A, 38B, or 38C that is built into the tubing string. Switch 50 may be a simple rocker switch, hall effect switch, optical switch, etc.

In certain embodiments, switch 50 may be a Radio Frequency Identification (RFID) switch, RuBee (IEEE standard 1902.1) base switch, resistive ID switch, or other addressable switch, as is known to routineers in the art. By using addressable switches 50 that are uniquely identifiable, depth may be validated by pipe segment tally. Such a feature is especially advantageous when multiple windows are being aligned, as they may be located within 30 feet of each other.

Figure 6:
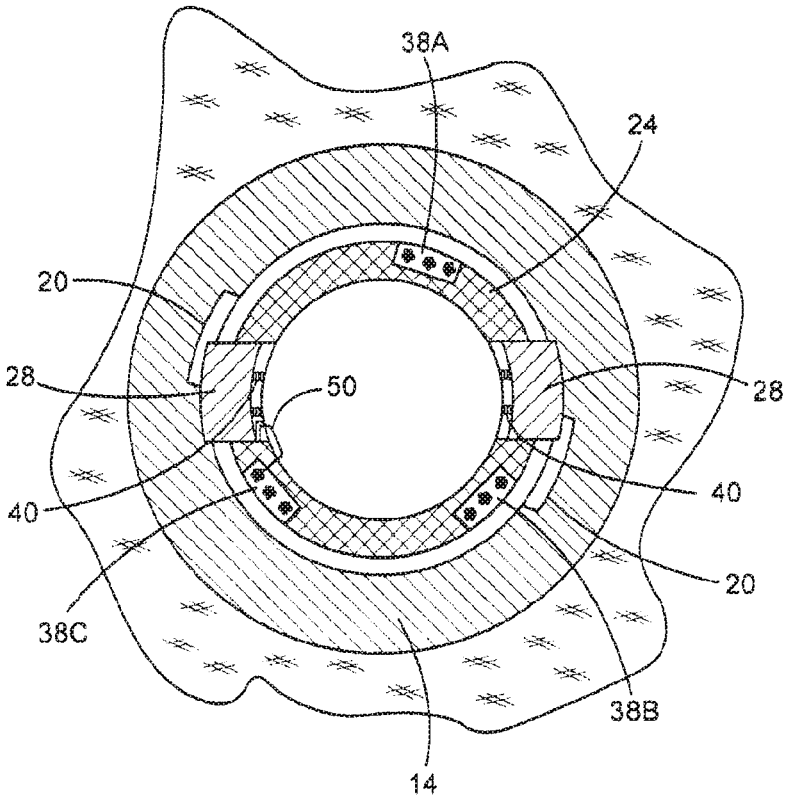
FIG. 6 is an axial cross-section of the assembly of FIG. 5, showing the latch keys disengaged within the latch couplings due to rotational misalignment.

Switch 50 is positioned adjacent latch key 28 and is actuated (either opened or closed, depending on the particular system design) when latch key 28 seats in or engages latch coupling 20, as shown in FIGS. 5-6. The condition of the actuated switch (either opened or closed) is thereby communicated to the surface operator via control line 38 to notify the operator that latch key 28 is seated in latch coupling 20 (or unseated, as the case may be). As shown in FIG. 5, as latch key 28 is radially extended into latch coupling 20, spring contact switch 50 is fully extended and triggered. In FIG. 6, latch key 28 is rotatively misaligned from latch coupling 20 and is therefore in a radially inward position. Accordingly, spring contact switch 50 is compressed and not triggered.

Figure 7:
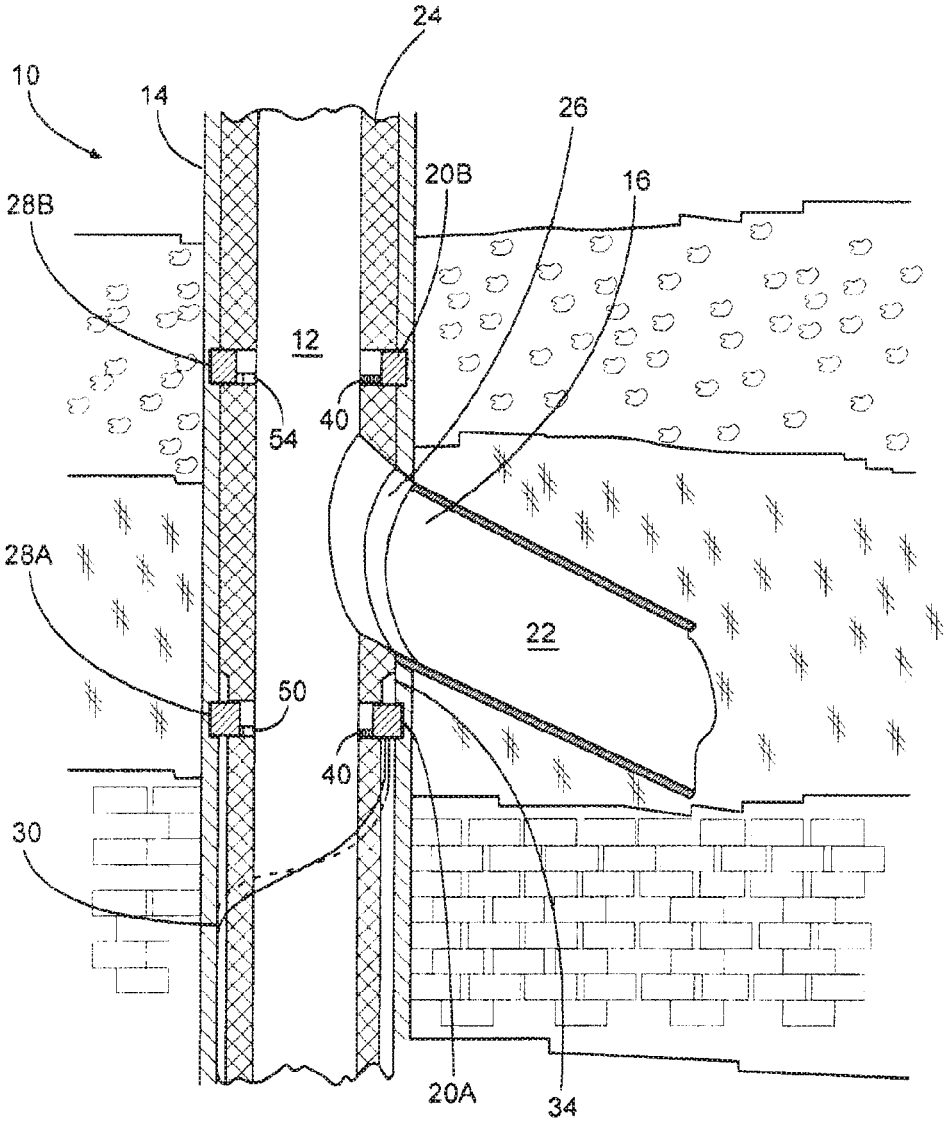
FIG. 7 is an axial cross-section of the well system according to an alternate embodiment, showing a depth position indicating latch coupling engagement switch and a separate radial orientation indicating latch coupling engagement switch.
Figure 8:
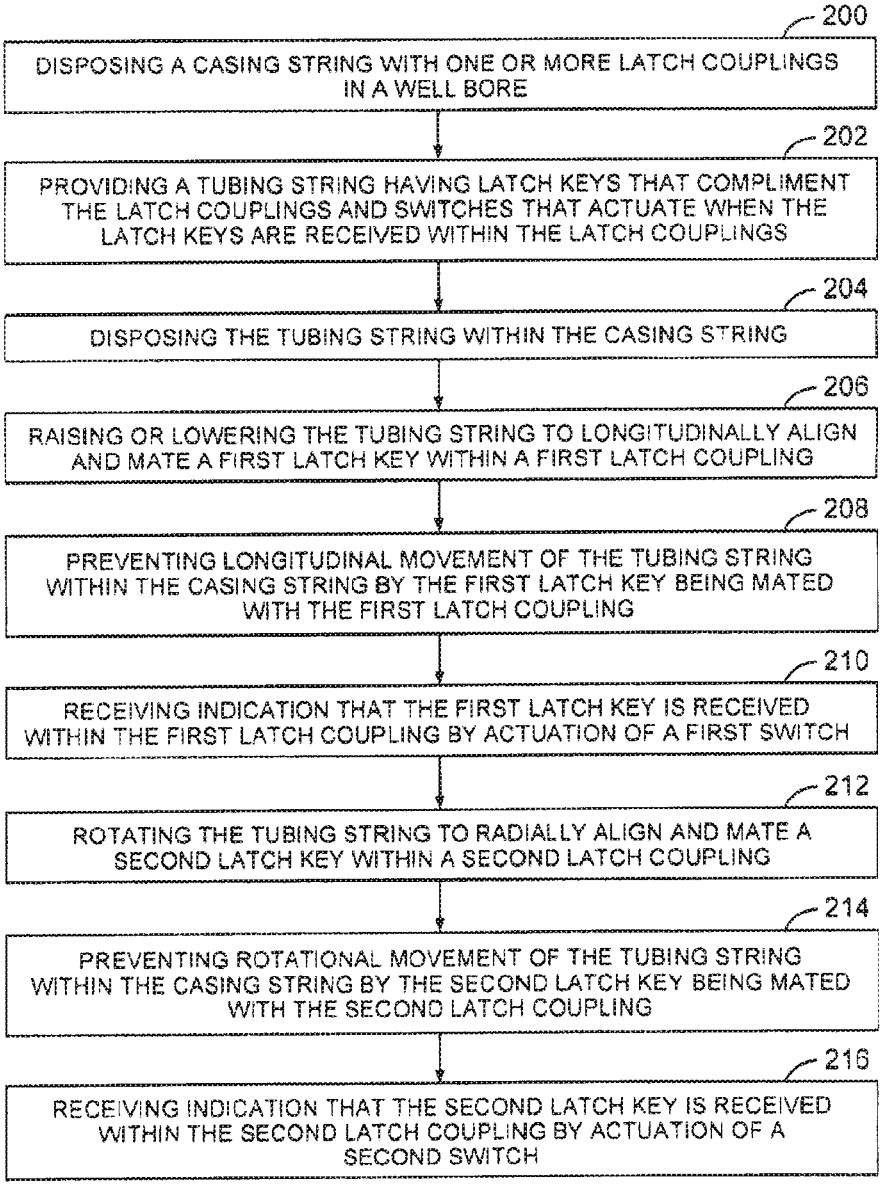
FIG. 8 is a block level flow chart diagram of a method for orienting a tool in a well borehole according to an embodiment that uses an arrangement of a depth position indicating latch coupling engagement switch and a separate radial orientation indicating latch coupling engagement switch, according to FIG. 7.

FIG. 7 shows well system 10 according to an alternate embodiment, in which a depth position indicating switch 52 and a radial orientation indication switch 54 are provided with latch couplings 28A, 28B, respectively. FIG. 8 illustrates an exemplary method according to one embodiment that corresponds to the system of FIG. 7. Referring to both FIGS. 7 and 8, at steps 200 and 202, the system 10 including the casing string with latch couplings and tubing string with latch keys that complement the latch couplings is provided. To the extent a depth latch coupling 28A is utilized to set a tubing string at a relative depth, the latch coupling may be a 360 degree radial groove along the interior surface of the outer tubing string. At step 204, the tubing string is run into the casing string, and at step 206, the tubing sting is moved axially to align latch key 28A with latch coupling 20A. Once a latch key 28A seats in the latch coupling 20A, at step 210, depth position indicating switch 52 triggers to notify the operator that the inner tubing string is positioned at a particular depth. As indicated in step 208, engaged latch key 28A/latch coupling 20A cooperate to prevent or minimize further axial movement of the tubing string within the casing string.

Thereafter, as shown in step 212, the inner tubing sting may be rotated until a rotational latch key 28B seats in a radial orientation latch coupling 20B. That is, a typical sequence is to set the tubing string to the proper depth by setting the depth latch key 28A into the depth latch coupling 20A; once the depth latch key 28A has been properly set, the tubing string is rotated azimuthally to set the tubing string milling window in correct orientation to the casing window. The radial orientation latch coupling 28B may be disposed within the depth latch such that only a single key need be utilized, or the depth and radial keys/latch combinations may be separately disposed as indicated in FIG. 7. When the azimuthal latch key 28B is engaged with azimuthal latch coupling 20B, then at step 216, the surface operator receives notification via the control lines 38 that the tubing string is set and ready for milling. As shown in step 214, engaged latch key 28B/latch coupling 20B cooperate to prevent or minimize further rotational movement of the tubing string within the casing string.

Switches 52, 54 may be wired in series or parallel to the surface. If additional windows are installed, then associated switches may also be wired in series with the main assembly with the purpose of notifying the surface operator that the milling windows are properly set. That is, in one embodiment, switches 50, 52, 54 provide a single system notification. Alternatively, if resistive ID or other addressable switches are used, notification to the surface operator that the milling windows are properly set may be readily provided. Such arrangement is particularly advantageous when numerous latch keys are used.

Figure 9:
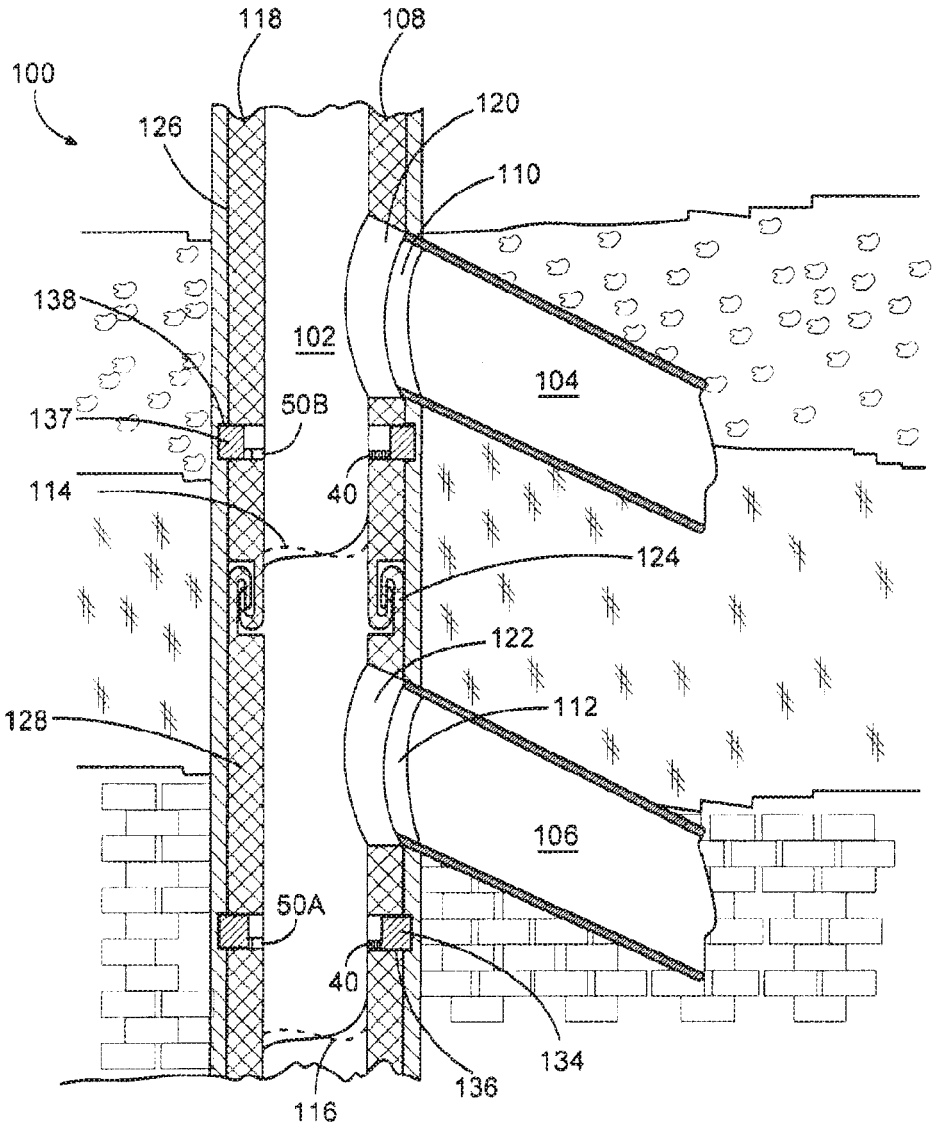
FIG. 9 is an axial cross-section of a well system having a parent wellbore and two lateral wellbores, along with a casing string and a tool having a tubing swivel disposed in the parent wellbore, according to an embodiment.
Figure 11:
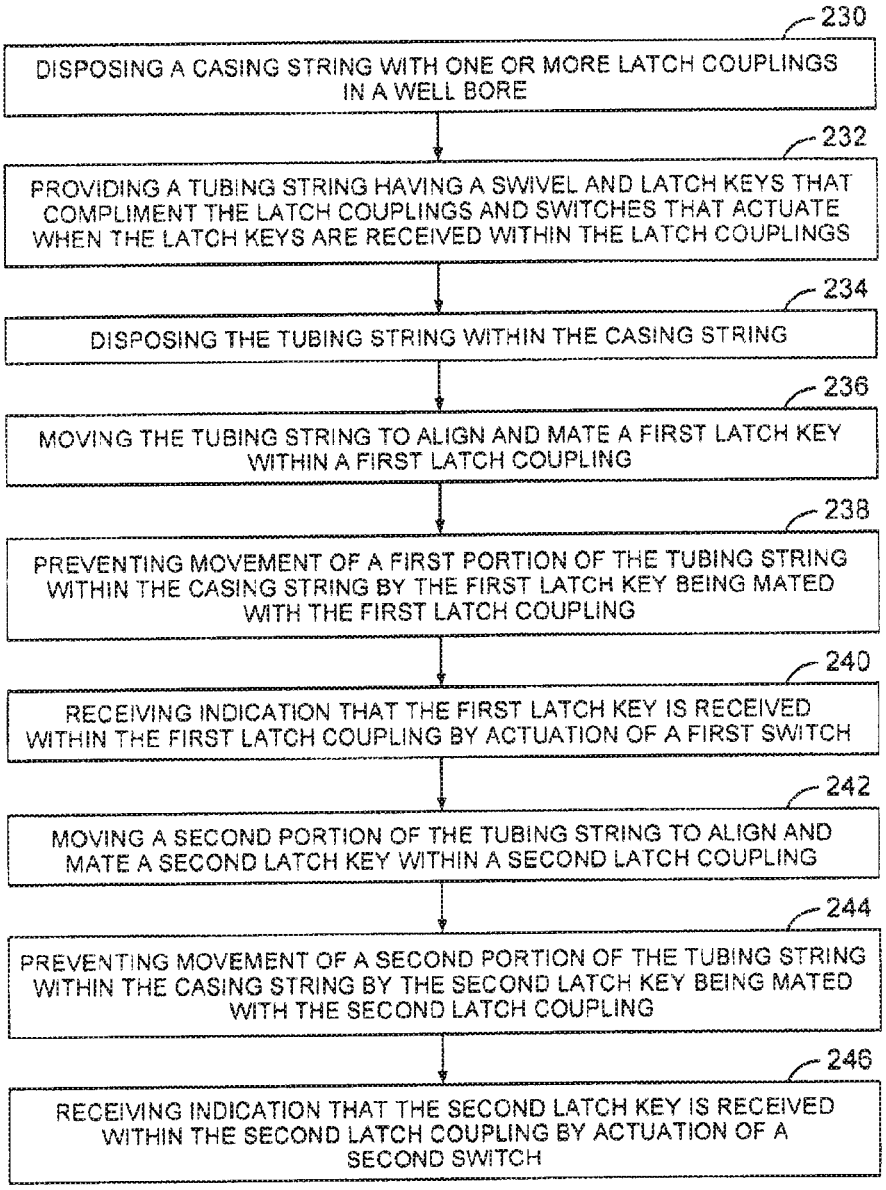
FIG. 11 is a block level flow chart diagram of a method for orienting a tool in a well system having a parent wellbore and two lateral wellbores, according to FIGS. 9 and 10.

FIG. 9 depicts an embodiment of a multilateral wellbore system 100 that includes a parent wellbore 102 and two lateral wellbores 104, 106 extending from the parent wellbore 102. FIG. 11 illustrates an exemplary method according to one embodiment that corresponds to the system of FIG. 9. Referring to both FIGS. 9 and 11, at step 230, a casing string 108 is disposed in the parent wellbore 102. The casing string 108 includes a first window 110 associated with lateral wellbore 104 and a second window 112 associated with lateral wellbore 106. The lateral wellbores 104, 106 can be accessed through the windows 110, 112. The casing string 108 also includes devices 114, 116 for orienting parts or sections of a tubing string 118 with respect to the casing string 108 in the parent wellbore 102. Each of the devices 114, 116 may be a mule shoe.

At step 232, a tubing string is provided. The tubing string 118 may include a tubing string window 120 aligned generally with the window 110 and a second tubing string window 122 aligned generally with the second window 112. In other embodiments, the tubing string 118 may include portions generally aligned with the windows 110, 112 through which tubing string windows can be made.

In step 234, tubing string 118 is disposed within casing string 108. The tubing string 118 may be positioned using various techniques, including the techniques described with reference to FIGS. 2-5 for generally aligning one tubing string window with one casing string window. In some embodiments, the tubing string 118 can be positioned in sections using a component such as a joint 124.

For example, the tubing string 118 may include a first section 126 associated with the tubing string window 120 and a second section 128 associated with the second tubing string window 122. At step 236, the second section 128, coupled to the first section 126 by the joint 124, can be positioned to a desired position by using techniques similar to those described with reference to FIGS. 2-4. A latch coupling 134 associated with the casing string can receive a latch key 136 associated with the second section 128 to prevent the second section 128 from rotating and/or moving axially with respect to the casing string 108, as indicated in step 238. At step 240, switch 50A provides indication to the operator that latch key 136 is engaged with latch coupling 134.

After the second section 128 is positioned, according to step 242, the first section 126 may be radially moved independently of the second section 128 due to joint 124 using any suitable technique. The technique may depend in part on the configuration of the joint 124, which may include any devices and may be any shape that allows the first section 126 to be moved relative to the second section 128.

Figure 10:
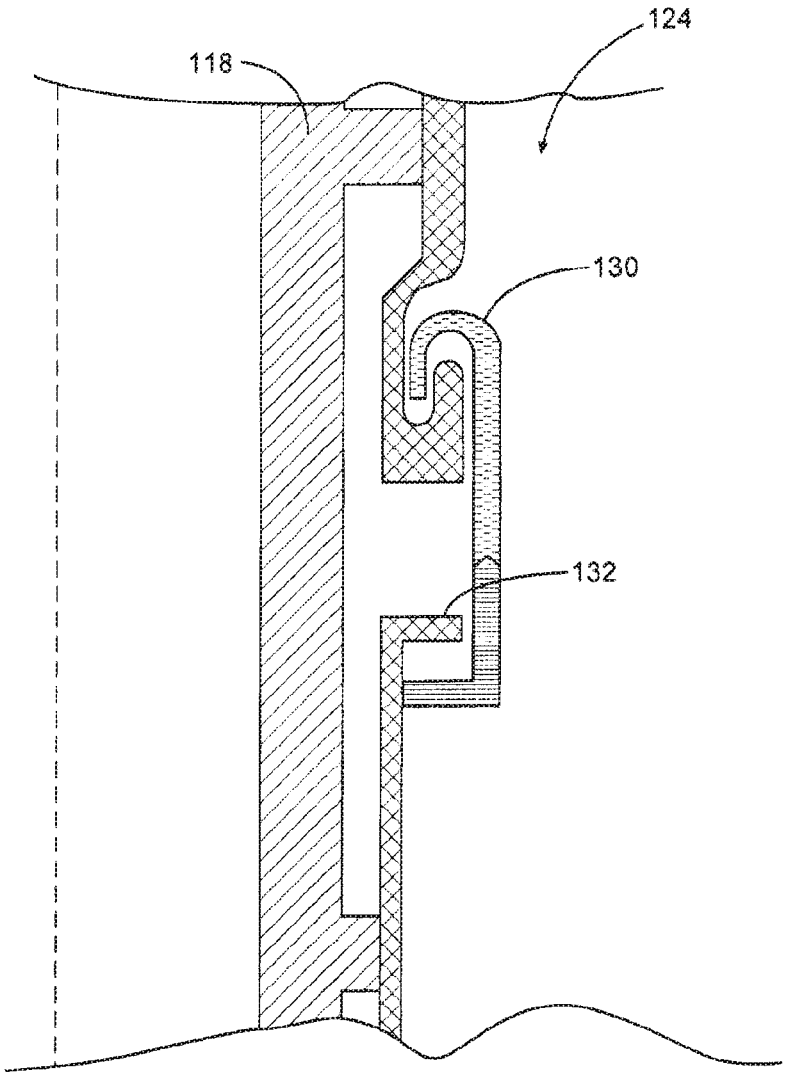
FIG. 10 is an enlarged axial cross-section of a portion of the tubing swivel of FIG. 9.

For example, FIG. 10 depicts a cross-sectional view of part the casing string 108 and the tubing string 118 at the joint 124 according to one embodiment. The joint 124 includes a tubing swivel 130 and a telescoping joint 132 in the tubing string 118. The tubing swivel 130 allows the first section 126 to be rotated independently of the second section 128. In some embodiments, the tubing swivel 130 can be selectively locked to prevent rotation and/or can include rotational limitations to prevent the amount of rotation allowed by the tubing swivel 130. The telescoping joint 132 allows the depth of first section 126 to change (both increase and decrease) independently of the depth of the second section 128. In some embodiments, the telescoping joint 132 is locked into a position until it is selectively unlocked to allow telescoping to provide an increase or decrease in depth by the first section 126. The first section 126 may be positioned using any suitable technique, such as the techniques described with reference to FIGS. 2-4. When the first section 126 is positioned, a second latch coupling 137 of the casing string 108 can receive a first section latch key 138 to prevent the first section 126 from rotating with respect to the casing string 108, as indicated in step 244. In step 246, switch 50B provides indication to the operator that latch key 138 is engaged with latch coupling 137.

Although FIG. 9 shows one latch key 136 and latch coupling 134 for fixing the position of the lower section 128 and one latch key 138 and latch coupling 137 for fixing the position of the upper section 126 of the casing string, the disclosure is not limited to such an arrangement. For example, a complementary latch key/latch coupling pair may be replaced by two latch key/latch coupling pairs—one 360 degree latch key/latch coupling pair to set the depth of that section and a second latch key/latch coupling pair to set the section's radial position, such as the arrangement shown in FIG. 7. In other words, steps 206-216 (FIG. 8) may be substituted for steps 236-240, and/or steps 242-246.

Latch couplings according to certain embodiments of the present invention can be configured to include a selective latch coupling profile that corresponds to a specific latch key profile on a tubing string, but does not correspond to a second latch key profile on the tubing string. When the tubing string is at the second position, the selective latch coupling profile can receive the specific latch key profile and prevent the tubing string from rotating. Using a selective latch coupling, each portion of a tubing string can be selective to a specific latch coupling profile.

In another embodiment of a multiple stage system having a number of milling windows, the primary notification may be a depth indicating switch 52. A separate circuit for radial indicating switch 54 may be provided. This circuit may couple switch 54 to an indicator, annunciator, control logic, or similar device, using control lines 38, for example, to provide notification to the operator at the surface that switch 54 is in an actuated state. For example, in a basic embodiment, the circuit may simply connect switch 54 between a power source and a relay in series, where the relay actuates the indicator, annunciator, control logic, or other device to provide notification to the operator of the state of switch 54. As such basic circuits are well known in the art, further details are not provided.

In yet another embodiment, the system 10 may include a down hole control module that determines which switch or series of switches are engaged from one to a multiple number of switches that are wired in parallel or in series, or from individually addressable switches whose actuation may be uniquely identified by the operator. The control module then telemeters an appropriate code to the surface operator via control lines 38.

In summary, methods and systems for orienting a tool in a wellbore have been described. Embodiments of the system may generally have a first pipe having a wall a portion of which defines a target, the wall defining an inner region, a second pipe capable of being disposed in the inner region of the first pipe, a portion of the second pipe having a second pipe wall a portion of which defines a target, a device carried by at least one of the first pipe or second pipe and capable of preventing constraining relative movement of the two pipes at least rotationally or axially, a switch coupled to the device so as to actuate when the device is in a particular configuration, and a circuit operatively coupled between the switch and an indicator for notifying an operator of the configuration of the switch.

An embodiment of the method may generally include providing a casing string having a latch coupling and a casing string window associated with a lateral wellbore, providing a tubing string having a tubing string window and a latch key, disposing the tubing string into the wellbore to a position at which at least part of the tubing string window is adjacent to at least part of the casing string window and at which the latch coupling is configured to receive the latch key to prevent rotation and/or axial translation of the tubing string with respect to the casing string, actuating a switch by the latch key when the latch key is received in the latch coupling, and notifying an operator by a circuit when the switch is actuated.

Another embodiment of the method may generally include providing a casing string having a first and second latch couplings and first and second casing string windows associated with first and second lateral bores, providing a tubing string having a first tubing string window and a first latch key located in a first section of the tubing string and a second tubing string window and a second latch key located in a second section of the tubing string, providing within the tubing string a joint that demarcates the first section from the second section and that enables movement of the second section with respect to the first section, disposing the tubing string into the casing string to a position at which at least part of the first tubing string window is adjacent to at least part of the first casing string window and at which the first latch coupling is configured to receive the first latch key to prevent at least one of the group consisting of rotation and axial translation of the first section of the tubing string with respect to the casing string, actuating a first switch by the first latch key when the first latch key is received in the first latch coupling, and notifying an operator by a circuit when the first switch is actuated.

Any of the foregoing embodiments may include any one of the following elements or characteristics, alone or in combination with each other: At least one control line coupled to the switch and forming a part of the circuit; the first pipe is a casing string; the second pipe is a tubing string having a latch key; the device is a latch coupling capable of receiving the latch key; the switch is coupled to the latch key; a spring capable of extending the latch key radially outward from an outer boundary of the tubing string; the tubing string includes a plurality of latch keys in a first configuration; the latch coupling includes a plurality of recessed latch couplings in a second configuration matching the first configuration of the plurality of latch keys to receive the plurality of latch keys; a plurality of switches operatively coupled to the plurality of latch keys, wherein each of the plurality of latch keys is associated with one of the plurality of switches; the plurality of switches are connected in series within the circuit; the plurality of switches are connected in parallel within the circuit; the plurality of switches are individually addressable and uniquely identifiable; a first of the plurality of latch couplings is arranged to prevent axial translation but allow rotation of the tubing string with respect to the casing string; a first of the plurality of latch keys corresponds to the first latch coupling and is operatively coupled to a first of the plurality of switches; a second of the plurality of latch couplings is arranged to prevent rotation of the tubing string with respect to the casing string; a second of the plurality of latch keys corresponds to the second latch coupling and is operatively coupled to a second of the plurality of switches; the first latch coupling is disposed at an elevation further downhole than the second latch coupling; providing a first latch coupling on the casing string arranged to prevent axial translation but allow rotation of the tubing string with respect to the casing string; providing a second latch coupling on the casing string arranged to prevent rotation of the tubing string with respect to the casing string; providing a first latch key on the tubing string arranged to be received in the first latch coupling and a first switch on the tubing string arranged to actuate with the first latch key is received in the first latch coupling; providing a second latch key on the tubing string arranged to be received in the second latch coupling and a second switch on the tubing string arranged to actuate with the second latch key is received in the second latch coupling; axially moving the tubing string within the casing string until the first latch key is received in the first latch coupling; rotating the tubing string within the casing string until the second latch key is received in the second latch coupling; notifying the operator by the circuit when the second switch is actuated; notifying the operator by the circuit when the first switch is actuated; moving the second section of the tubing string with respect to the first section of the tubing string to a position at which at least part of the second tubing string window is adjacent to at least part of the second casing string window and at which the second latch coupling is configured to receive the second latch key to prevent at least one of the group consisting of rotation and axial translation of the second section of the tubing string with respect to the casing string; actuating a second switch by the second latch key when the second latch key is received in the second latch coupling; rotating the second section with respect to the first section; axially translating the second section with respect to the first section; assigning a first address to the first switch; assigning a second address to the second switch; and identifying actuation of the first switch using the first address.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A system capable of being disposed in a wellbore, the system comprising:

a first pipe having a wall a portion of which defines a target, the wall defining an inner region;

a second pipe having a plurality latch keys, said second pipe capable of being disposed in the inner region of the first pipe, a portion of the second pipe having a second pipe wall a portion of which defines a target;

a plurality of latch couplings carried by at least one of the first pipe or second pipe and capable of preventing constraining relative movement of the two pipes at least rotationally or axially, wherein said latch couplings are capable of receiving the latch keys;

a plurality of switches coupled to said plurality of latch couplings, each of said plurality of switches associated with one of said plurality of latch keys so as to actuate when the device is in a particular configuration; and a circuit operatively coupled between said plurality of switches and an indicator for notifying an operator of the configuration of said plurality of switches; and wherein a first of said plurality of latch couplings is arranged to prevent axial translation but allow rotation of said second pipe with respect to said first pipe;

a first of said plurality of latch keys corresponds to said first latch coupling and is operatively coupled to a first of said plurality of switches;

a second of said plurality of latch couplings is arranged to prevent rotation of said first pipe with respect to said second pipe; and a second of said plurality of latch keys corresponds to said second latch coupling and is operatively coupled to a second of said plurality of switches.

2. The system of claim 1, wherein the second pipe comprises:

at least one control line coupled between said switch and said indicator and forming a part of said circuit.

3. The system of claim 1, wherein:

the first pipe is a casing string;

the second pipe is a tubing string.

4. The system of claim 3, wherein the tubing string further comprises:

a spring urging the first of said plurality of latch keys radially outward from an outer boundary of the tubing string.

5. The system of claim 3, wherein:

the plurality of latch keys have a first configuration; and wherein the plurality of latch couplings are recessed and have a second configuration matching the first configuration of the plurality of latch keys to receive the plurality of latch keys.

6. The system of claim 1, wherein:

said plurality of switches are connected in series within said circuit.

7. The system of claim 1, wherein:

said plurality of switches are connected in parallel within said circuit.

8. The system of claim 1, wherein:

said plurality of switches are individually addressable and uniquely identifiable.

9. The system of claim 1, wherein:

said first latch coupling is disposed at an elevation spaced apart from said second latch coupling.

10. The system of claim 1, wherein at least one of the targets in the wall of the first pipe and the second pipe is a first window.

11. The system of claim 10, wherein the first window defines an opening in the pipe wall.

12. The system of claim 11, wherein the each of the targets in the respective pipe walls is a window.

13. A method for orienting a tubing string with respect to a casing string in a wellbore, the casing string having a latch coupling and a casing string window associated with a lateral wellbore, the method comprising:

providing a tubing string having a tubing string window and a latch key;

disposing the tubing string into the wellbore to a position at which at least part of the tubing string window is adjacent to at least part of the casing string window and at which the latch coupling is configured to receive the latch key to prevent at least one of the group consisting of rotation and axial translation of the tubing string with respect to the casing string;

actuating a switch by said latch key when said latch key is received in said latch coupling; and providing a signal to an operator when said switch is actuated;

providing a first latch coupling on said casing string arranged to prevent axial translation but allow rotation of said tubing string with respect to said casing string;

providing a second latch coupling on said casing string arranged to prevent rotation of said tubing string with respect to said casing string;

providing a first latch key on said tubing string arranged to be received in said first latch coupling and a first switch on said tubing string arranged to actuate with said first latch key is received in said first latch coupling;

providing a second latch key on said tubing string arranged to be received in said second latch coupling and a second switch on said tubing string arranged to actuate with said second latch key is received in said second latch coupling;

axially moving said tubing string within said casing string until said first latch key is received in said first latch coupling; then rotating said tubing string within said casing string until said second latch key is received in said second latch coupling; and providing a signal to said operator by said circuit when said second switch is actuated.

14. The method of claim 13, further comprising:

providing a signal to said operator by said circuit when said first switch is actuated.

15. A method for orienting a tubing string with respect to a casing string in a wellbore, the casing string having a first and second axially-restraining latch couplings, first and second rotationally-restraining latch couplings and first and second casing string windows associated with first and second lateral bores, the method comprising:

providing a tubing string having a first tubing string window a first axially-restraining latch key and a first rotationally-restraining latch key located in a first section of said tubing string and a second tubing string window, a second axially-restraining latch key and a second rotationally-restraining latch key located in a second section of said tubing string;

providing within said tubing string a joint that demarcates said first section from said second section and that enables movement of said second section with respect to the first section;

disposing the tubing string into the casing string to a rotational position and an axial position at which at least part of the first tubing string window is adjacent to at least part of the first casing string window and at which the first axially-restraining latch coupling receives the first axially-restraining latch key to prevent axial translation of the first section of said tubing string with respect to the casing string, and at which the first rotationally-restraining latch coupling receives the first rotationally-restraining latch key to prevent rotation of the first section of said tubing string with respect to the casing string;

actuating a first switch by said first axially-restraining latch key being received in said first axially-restraining latch coupling, and said first rotationally-restraining latch key being received in said first rotationally-restraining latch coupling; and providing a signal to an operator by a circuit when said first switch is actuated.

16. The method of claim 15, further comprising:

moving said second section of said tubing string with respect to said first section of said tubing string to a position at which at least part of the second tubing string window is adjacent to at least part of the second casing string window and at which the second axially-restraining latch coupling receives the second axially-restraining latch key or at which the second rotationally-restraining latch coupling receives the second rotationally-restraining latch key to prevent at least one of the group consisting of rotation and axial translation of the second section of said tubing string with respect to the casing string.

17. The method of claim 16, further comprising:

actuating a second switch by said second axially-restraining latch key being received in said second axially-restraining latch coupling or by said second rotationally-restraining latch key being received in said rotationally-restraining latch coupling; and providing a signal to said operator by said circuit when said second switch is actuated.

18. The method of claim 17, further comprising:

assigning a first address to said first switch;

assigning a second address to said second switch; and identifying actuation of said first switch using said first address.

19. The method of claim 16, further comprising:

rotating said second section with respect to said first section.

20. The method of claim 16, further comprising:

axially translating said second section with respect to said first section.

* * * * *